US007950942B2

(12) United States Patent
Klinger et al.

(10) Patent No.: US 7,950,942 B2
(45) Date of Patent: May 31, 2011

(54) SECURED PLUG CONNECTION AND METHOD FOR ITS PRODUCTION

(75) Inventors: Herbert Klinger, Nuremberg (DE); Norbert Behrendt, Stein (DE); Gerhard Thomas, Furth (DE)

(73) Assignee: KNORR-BREMSE Systeme Fuer Nutzfahrzeuge GmbH, Munich (DE)

( * ) Notice: Subject to any disclaimer, the term of this patent is extended or adjusted under 35 U.S.C. 154(b) by 0 days.

(21) Appl. No.: 12/312,167

(22) PCT Filed: Oct. 25, 2007

(86) PCT No.: PCT/EP2007/009256

§ 371 (c)(1),
(2), (4) Date: Dec. 2, 2009

(87) PCT Pub. No.: WO2008/049610

PCT Pub. Date: May 2, 2008

(65) Prior Publication Data

US 2010/0068910 A1 Mar. 18, 2010

(30) Foreign Application Priority Data

Oct. 27, 2006 (DE) ..... 10 2006 050 800

(51) Int. Cl.
*H01R 13/64* (2006.01)

(52) U.S. Cl. ..... 439/247; 439/362

(58) Field of Classification Search ..... 439/247, 439/248, 271, 362, 660
See application file for complete search history.

(56) References Cited

U.S. PATENT DOCUMENTS

| | | | | |
|---|---|---|---|---|
| 4,934,950 | A * | 6/1990 | Green et al. | 439/681 |
| 5,391,091 | A * | 2/1995 | Nations | 439/378 |
| 5,473,510 | A * | 12/1995 | Dozier, II | 361/719 |
| 5,836,787 | A | 11/1998 | Kodama | |
| 6,102,711 | A * | 8/2000 | Hanada et al. | 439/70 |
| 6,126,458 | A | 10/2000 | Gregory, II et al. | |
| 6,257,933 | B1 * | 7/2001 | Awaji | 439/660 |
| 6,358,075 | B1 * | 3/2002 | Tischner | 439/248 |
| 6,592,387 | B2 * | 7/2003 | Komenda et al. | 439/247 |
| 7,326,092 | B2 * | 2/2008 | Fedder et al. | 439/681 |
| 7,393,228 | B2 * | 7/2008 | Kabasawa et al. | 439/247 |

(Continued)

FOREIGN PATENT DOCUMENTS

WO 2004/060723 7/2004

OTHER PUBLICATIONS

European Patent Office, International Preliminary Report on Patentability and Written Opinion, Apr. 28, 2009, from International Patent Application No. PCT/EP2007/009256, filed on Oct. 25, 2007.

(Continued)

*Primary Examiner* — Thanh-Tam T Le
(74) *Attorney, Agent, or Firm* — Kenyon & Kenyon LLP

(57) ABSTRACT

A plug connection between electrical and/or electronic components, in which electrical plug contacts of a plug which is arranged directly adjacently to one component are inserted into a socket which is arranged directly adjacently to the other component, with the components being interlocked with one another by a connection arrangement or being combined to form an assembly, and in which a separate plug connection securing arrangement which is independent of the connection arrangement of the components is provided to secure the plug connection against movements of the plug relative to the socket and vice versa.

12 Claims, 1 Drawing Sheet

U.S. PATENT DOCUMENTS

| | | | | |
|---|---|---|---|---|
| 7,458,837 | B2 * | 12/2008 | Mineo | 439/248 |
| 7,641,522 | B2 * | 1/2010 | Carcangiu et al. | 439/801 |
| 7,670,175 | B2 * | 3/2010 | Suzuki et al. | 439/578 |
| 7,727,000 | B2 * | 6/2010 | Minich | 439/377 |

OTHER PUBLICATIONS

European Patent Office, Translation of International Preliminary Report on Patentability and Written Opinion, May 5, 2009, from International Patent Application No. PCT/EP2007/009256, filed on Oct. 25, 2007.

State Intellectual Property Office of the People's Republic of China, Office Action (no references cited), Nov. 12, 2010, from related Chinese Patent Application Serial No. 200780040034.1.

* cited by examiner

SECURED PLUG CONNECTION AND METHOD FOR ITS PRODUCTION

FIELD OF THE INVENTION

The present invention relates to a plug connection between electrical and/or electronic components, in which electrical plug contacts of a plug which is arranged directly adjacently to one component are inserted into a socket which is arranged directly adjacently to the other component, with the components being interlocked with one another by a connection arrangement or being combined to form an assembly. Furthermore, a method for producing such a plug connection is also described herein.

BACKGROUND INFORMATION

In many applications, the control electronics for driving actuator/sensor assemblies in brake assemblies of utility vehicles are accommodated in a separate module in order to enable them to be used in different models. To electrically connect an actuator/sensor assembly to the associated control electronics, a central plug connection must be used for the signal/current transmission to the actuator/sensor assembly. In this arrangement, the control device containing the control electronics is usually plugged directly onto the actuator/sensor assembly and the respective housings are screwed together. Since in this case, at least the plug or the socket of the plug connection are arranged at the housing of the actuator/sensor assembly, and the associated socket or the associated plug, respectively, of the plug connection are arranged at the housing of the control device, directly, i.e. without further cable connection, the plug connection is usually also established automatically as part of the connection process of the two housings in that, by joining together the two housings, the plug and the socket are simultaneously aligned with one another and then engage one another.

Although the control device and the actuator/sensor assembly are then firmly connected to one another, the plug and the socket are not so that, under operating conditions, the possibility cannot be ruled out that, due to shaking and vibration stresses, movements will occur between the plug and the socket, even if they are small. This leads to contact friction and thus damage to the contact surfaces which, apart from a transmission of wrong signals, can lead up to a total failure of the control.

As an alternative, cable trees are also used between the actuator/sensor assembly and the associated control unit which is then not directly interlocked but arranged remotely. Although these guarantee a certain mechanical decoupling of the plug connection from the source of the structure-borne excitation, they lead to higher costs and failure risks due to additional lines, the associated installation effort and additional connecting plugs.

By comparison, the exemplary embodiments and/or exemplary methods of the present invention are based on the object of developing a plug connection of the type initially mentioned in such a manner that the abovementioned disadvantages are avoided. Furthermore, a method for producing such a plug connection is to be specified.

According to the exemplary embodiments and/or exemplary methods of the present invention, this object may be achieved by the features of the exemplary embodiments and/or exemplary methods of the present invention described herein.

SUMMARY OF THE INVENTION

The exemplary embodiments and/or exemplary methods of the present invention is based on the concept that a separate plug connection securing arrangement is provided which is independent of the connection arrangement of the components and secures the plug connection against movements of the plug relative to the socket and vice versa. Neither the plug nor the socket can then carry out relative movements with respect to one another which damage the electrical contacts. The decisive factor in this arrangement is that the connection or the securing of the connection between plug and socket is independent of the connection between the two electrical or electronic components and is established separately from the latter.

To establish the secured plug connection according to the present invention, the housings of the two components, for example a control device and an actuator/sensor assembly of a braking device of a utility vehicle are first positioned in assembly position with respect to one another. By correspondingly arranging the plug and the socket at the respective housing, the plug and the socket can already be positioned with respect to one another in this assembly position in such a manner that when the housings of the components are joined, the plug is also at least aligned with the socket. As well, the plug connection, i.e. an electrical contact between plug and socket, can already be established at least partially in this manner. The plug connection securing arrangement is then used for completing or securing the plug connection, for example in the form of a screw connection which is tightened. The plug is fixed in position with respect to the socket by the firm screwing so that no further relative movements which negatively influence the contact retention capability can take place.

Advantageous developments and improvements of the exemplary embodiments and/or exemplary methods of the present invention specified herein are possible by the measures further described herein.

So that the plug connection is produced at least partially simultaneously with the joining of the housings of the components, relatively small tolerances must be maintained in the positioning of the plug with respect to the housing of the one component or the socket relative to the housing of the other component which is associated with a certain cost expenditure. By comparison, it may be advantageous if the plug on the one component and/or the socket on the other component is held via an elastic body in such a manner that the latter is deformable due to forces which occur during the production and/or in the securing of the plug connection by the plug connection securing arrangement. The elastic body is then used for compensating for tolerance in the production or securing of the plug connection since, for example, the plug and/or the socket, as a condition of the elasticity, can be brought out of their initial position in a plane perpendicularly to the plug-in direction in such a manner that the plug is aligned with the socket and the plug connection can thus be produced at all.

As an alternative or additionally, the plug and the socket can already be aligned with one another or then already partially engage one another, for example, already in the assembly position of the components, the distance of the plug from the socket being too large or too small due to tolerances in the plug-in direction. The elastic body can then provide for a compensation in parallel with the plug-in direction by elastically deforming during the tightening of the screw connection in order to ensure that the plug achieves its full insertion depth in the socket.

In this arrangement, the elastic body can contain a circuit board which is flexible perpendicularly to the board plane, a lead frame which is flexible perpendicularly to the frame plane or a cable tree which is arranged inside one of the components. In this manner, an advantageous dual function is achieved since the circuit board or the lead frame, apart from its function as carrier of electrical and/or electronic components, simultaneously takes over the function of the elastic holder for the plug or the socket.

The plug connection securing arrangement may contain at least one screw connection which is screwed with its screw shank through a thread of the elastically supported socket or of the elastically supported plug and can be screwed into at least one threaded hole of one of the components in such a manner that the elastically supported plug or the elastically supported socket, when the screw is screwed into the threaded hole of the one component, is screwed in the direction of the socket rigidly supported at the other component or of the plug rigidly supported at the other component. The screw thus forms not only a securing arrangement of the connection between the plug and the socket but, when the screw connection is tightened, it simultaneously ensures that the plug elastically supported at the one component or the socket elastically supported at the one component is transported in the direction of the socket rigidly supported at the other component or of the plug rigidly supported at the other component in the sense of a linear guidance.

In this arrangement, the screw can be locked with its screw head against the plug rigidly supported at the one component or against the socket rigidly supported at the one component and conducted with its screw shank through a hole in the rigidly supported socket or in the rigidly supported plug.

In the best case, the plug connection securing arrangement, particularly the at least one screw connection can be reached from the outside with respect to the housing of the components. For example, this can be implemented by the plug connection securing arrangement being arranged accessibly on the side of housings of the components.

An exemplary embodiment of the present invention is shown in the drawing and explained in greater detail in the subsequent description.

DETAILED DESCRIPTION

Figure 1:
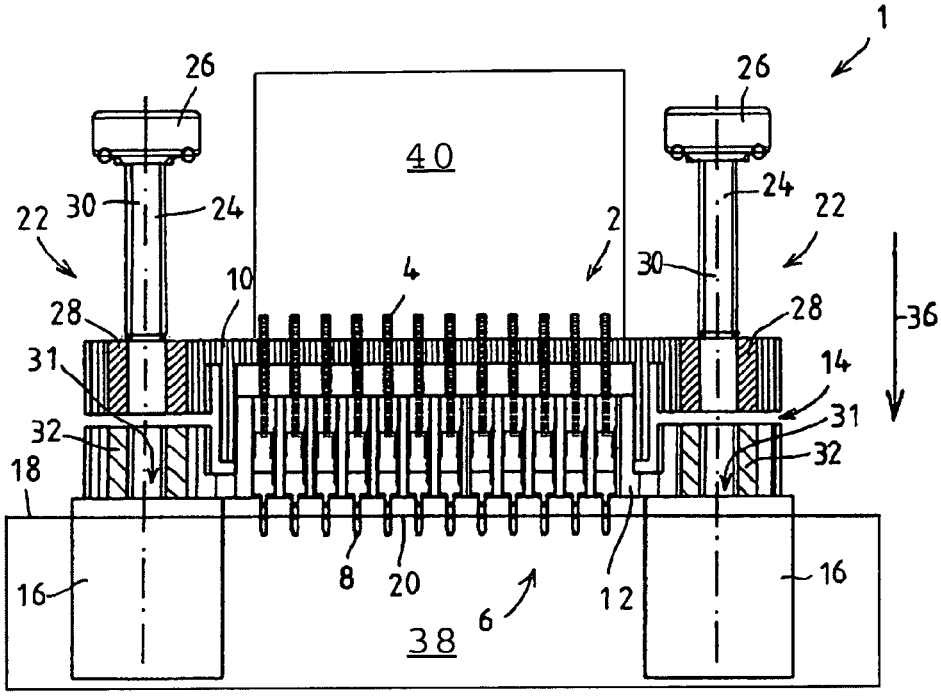
FIG. 1 shows a plug connection according to an exemplary embodiment of the present invention with a plug connection securing arrangement that is not yet tightened.

FIG. 1 shows a plug connection 1 between electrical and/or electronic components according to an exemplary embodiment of the present invention in which it is arranged between an actuator and sensor assembly 38, not shown here to scale, and a control device 40 allocated to this assembly, also not shown here to scale, of a braking device of a vehicle, particularly of a utility vehicle. In this arrangement, for example, a plug 2 of the plug connection 1 with flat contacts 4 is attached to the control device and a socket 6 of the plug connection 1 with ferrules 8 accommodating the flat contacts 4 is attached to the actuator and sensor assembly. Naturally, the allocation can also be reversed.

Together with the actuator and sensor assembly, the control device forms, for example, a pressure control module (DRM) as component of an electronic/pneumatic system, particularly a braking system, and the interface between the electronic part and the pneumatic part. The pressure control module converts electrically nominal brake pressure signals generated by a foot brake module and inserted into the control device into pneumatic brake pressures. This conversion is effected by an inlet/outlet solenoid valve combination which acts on a relay valve. A pressure sensor measures the adjusted brake pressure and reports it to the control device for a nominal-/actual-value comparison. The brake pressure can thus be controlled in a closed control loop. Furthermore, the pressure control module contains an electromagnetic back-up valve which blocks pneumatic control pressures of the foot brake module in order to provide for unaffected electrical pressure control. It is only when the electronics fail, that the back-up valve becomes active and the brake pressures are generated only on the basis of the pneumatic control pressures.

To establish the plug connection 1 according to the present invention, the housing of the control device and the housing of the actuator/sensor assembly are first positioned in assembly position with respect to one another in order to screw them together by a connecting arrangement, such as, for example, screws. In this arrangement, the plug 2 and the socket 6 may be arranged at the respective housing in such a manner that they automatically engage one another during the joining of the housings so that the plug connection 1 is at least partially also produced with the joining of the housings. This can be implemented, for example, by the assembly or joining direction of the housings being parallel to the plug-in direction of the plug connection 1 identified by an arrow 36.

Although, the plug connection 1 is thus established in principle, it is not yet fully completely assembled.

This is because, even with housings already completely joined, i.e. contacting each other along the butt joint, for example, a contact strip 10 of the plug 2, carrying the flat contacts 4, and a socket strip 12 with the ferrules 8, are still distant from one another by a clear width 14 by such an amount that the flat contacts 4 only partially engage the ferrules 8 in a contacting manner. Although the plug connection 1 is implemented partially to this extent since an electrical contact is already established between the flat contacts 4 and the ferrules 8, it is not yet finally completed or secured.

The ferrules 8 of the socket strip 12 may pass through prefabricated holes in a lead frame or a flexible circuit board 18 of the actuator and sensor assembly where they are, for example, welded, soldered or connected, e.g. by an insulation displacement technique. The lead frame 18 is used as circuit board and circuit carrier of electrical and electronic components of the actuator and sensor assembly and is constructed elastically in parallel with the plug-in direction 36 of the plug connection 1, for example due to the fact that it is laterally supported in the actuator and sensor assembly and its center area 20 can be deformed by a certain distance in parallel with the plug-in direction 36, which may be at least by the clear width 14 between the contact strip 10 and the socket strip 12. Whilst the contact strip 10 and especially the plug 2 are rigidly and stiffly attached at the housing of the control device, the socket strip 12 of the socket 6 is elastically connected to the actuator and sensor assembly at least in parallel with the plug-in direction 36 of the plug connection 1. Naturally, the plug 2 can also be supported by an elastic body and the socket 6 can be supported rigidly, and both the latter and the plug 2 can be supported by one elastic body each in the respective housing.

Apart from the screw connection by which the contacting housings are connected to one another, the plug connection securing arrangement which is separate from these and is independent is provided which secures the plug connection 1 against movements of the plug 2 relative to the socket 6 and vice versa. The final connection or the securing of the connection between plug 2 and socket 6 is in consequence independent of the connection between the two housings and is established separately from it. The plug connection securing arrangement can be constructed, for example, in the form of screw connections 22 between the contact strip 10 and the socket strip 12.

The screw connections 22 may be constructed at the lateral ends of the contact strip 10 and the socket strip 12 and in each case have a screw 24 which is locked with its screw head 26, for example, against the upper edge of a through socket 28 held in the contact strip 10. In this arrangement, the screw shank 30 passes through the through socket 28 and can be screwed through a threaded hole in the socket 6 which, for example, is formed by a threaded socket 32 held in the socket strip 12. Furthermore, cast domes 16 which are arranged in extension of and aligned with the screws 24 support the socket strip 12 which is provided with threaded blind holes 31 for screwing in the screw shanks 30. The cast domes 16 in turn are firmly and rigidly connected with the housing of the actuator and sensor assembly.

The through sockets 28, the threaded sockets 32, the cast domes 16 and the screws 24 may consist of metal and are injection molded into the contact strip 10 and into the socket strip 12, respectively, during an injection molding process in which the contact strip 10 and the socket strip 12 are produced as injection molding blanks, for example of plastic. At the edge of the screw head 26 pointing towards the end face of the through socket 28, the screw head 26 carries a seal 34, for example in the form of an O ring which seals against the end face of the through socket 28 when it rests there under pretension.

The screw connections 22, particularly the screw heads 26, can be reached from the outside with respect to the housing in order to be able to apply a tool. This can be implemented, for example, by the fact that the screw connections 22 are arranged to be accessible on the side at the housings.

Figure 2:
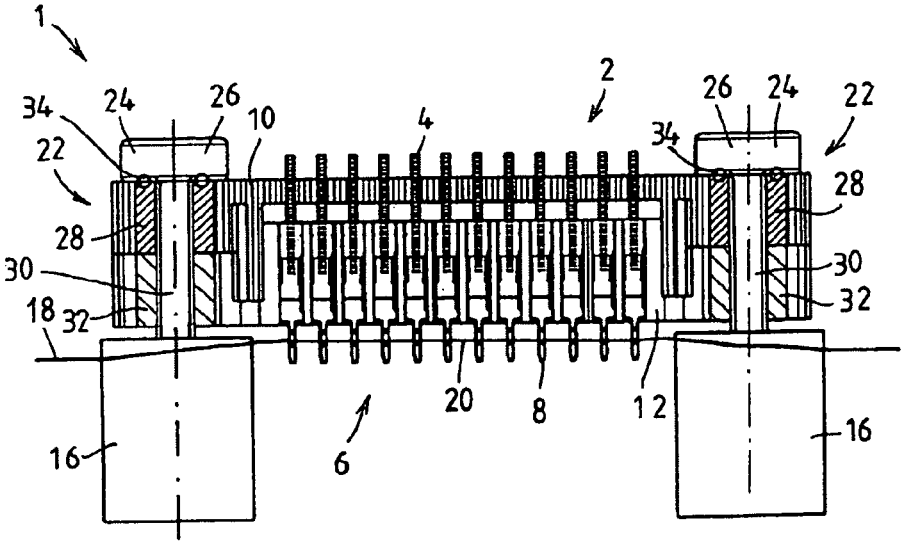
FIG. 2 shows the plug connection of FIG. 1 with the plug connection securing arrangement which is tightened.

Finally, to complete and to secure the plug connection 1, respectively, the screws 24 are screwed into the threaded blind holes 31 of the cast domes 16 as a result of which the socket strip 12 with its threaded socket 32 screws away from the cast domes 16 in the direction of the contact strip 10 until it abuts the latter and, as indicated diagrammatically in FIG. 2, the center area 20 of the lead frame 18 bends through towards the contact strip 10 during this process because it is pulled upward by the ferrules 8. On the one hand, the plug connection 1 is thus secured against relative movements between the plug 2 and the socket 6. On the other hand, the contact area between the flat contacts 4 and the ferrules 8 is sealed against dirt and moisture of the environment by the O rings 34 pressed against the end faces of the through sockets 28 by the screw heads 26.

In addition or instead of an elasticity in parallel with the plug-in direction 36, the elasticity can also exist in a plane perpendicular to the plug-in direction 36 in order to serve as tolerance compensation in this direction. The elastic body can also be formed by one or more cable trees, run within the housing of the respective component, with a certain excessive length by which the plug and/or the socket is then held there elastically. The excessive length of the cables then provides for the tolerance compensation with respect to the position of the plug 2 or of the socket 6 relative to the respective housing.

A list of the reference designations is as follows:

1 Plug connection;
2 Plug;
4 Flat contacts;
6 Socket;
8 Ferrules;
10 Contact strip;
12 Socket strip;
14 Clear width;
16 Cast dome;
18 Lead frame;
20 Center area;
22 Screw connection;
24 Screw;
26 Screw head;
28 Through socket;
30 Screw shank;
31 Threaded blind holes;
32 Threaded socket;
34 Seal; and
36 Arrow plug-in direction.

The invention claimed is:

1. A plug connection between electrical components or electronic components, comprising:

electrical plug contacts of a plug arranged directly adjacently to one component inserted into a socket arranged directly adjacently to another component;

a connection arrangement to interlock the components with one another or to combine the components to form an assembly; and a separate plug connection securing arrangement, which is independent of the connection arrangement of the components, secures the plug connection against movements of the plug relative to the socket and vice versa, wherein at least one of the following is satisfied: (i) the plug is held at the one component, and (ii) the socket is held at the other component via an elastic body so that the latter is deformable due to forces which occur at least one of during the production and during the securing of the plug connection by the plug connection securing arrangement wherein the elastic body is elastically deformable at least in parallel with a plug-in direction of the plug into the socket, and wherein the elastic body contains at least one of a circuit board which is flexible perpendicularly to the plane of the circuit board, a lead frame which is flexible perpendicularly to the plane of the lead frame, and a cable tree which is arranged inside one of the components.

2. The plug connection of claim 1, wherein the plug connection securing arrangement engages the plug and the socket and connects these with one another in at least one of an integrally locked manner, a positively locked manner, and a frictionally locked manner.

3. The plug connection of claim 1, wherein the plug connection securing arrangement includes at least one screw connection with a screw which is screwed with its screw shank through a thread of the elastically supported socket or of the elastically supported plug and can be screwed into at least one threaded hole of one of the components so that the elastically supported plug or the elastically supported socket, when the screw is screwed into the threaded hole of one of the components, is screwed in a direction of the socket rigidly supported at the other component or of the plug rigidly supported at the other component.

4. The plug connection of claim 3, wherein the screw is locked with its screw head against the rigidly supported plug or against the rigidly supported socket and is conducted with its screw shank through a through hole in the rigidly supported plug or in the rigidly supported socket.

5. The plug connection of claim 3, wherein at least two screw connections arranged laterally at the plug and the socket are provided.

6. The plug connection of claim 1, wherein the plug connection is arranged between at least one of an actuator assembly and a sensor assembly, and a control device allocated to the assembly.

7. The plug connection of claim 6, wherein the plug is arranged directly adjacently to a housing of the control device and the socket is arranged directly adjacently to a housing of at least one of the actuator assembly and the sensor assembly.

8. The plug connection of claim 1, wherein the plug connection securing arrangement is reachable from the outside with respect to housings of the components.

9. The plug connection of claim 8, wherein the plug connection securing arrangement is arranged accessibly on a side of housings of the components.

10. The plug connection of claim 1, wherein the plug connection securing arrangement interact with seals for sealing the plug connection.

11. A method for producing a plug connection, the method comprising:

positioning housings of two components in an assembly position, as a result of which either (i) a plug and a socket are simultaneously at least aligned with one another for forming a plug connection, or (ii) the plug and the socket are at least aligned with one another separately from the positioning of the housings; and completing and securing the plug connection by acting on a plug connection securing arrangement;

wherein the plug connection is between electrical components or electronic components, the plug connection including electrical plug contacts of the plug arranged directly adjacently to one component inserted into a socket arranged directly adjacently to another component, a connection arrangement to interlock the components with one another or to combine the components to form an assembly, and the plug connection securing arrangement, which is separate and independent of the connection arrangement of the components, secures the plug connection against movements of the plug relative to the socket and vice versa, wherein at least one of the following is satisfied: (i) the plug is held at the one component, and (ii) the socket is held at the other component via an elastic body, wherein the elastic body is elastically deformable at least in parallel with a plug-in direction of the plug into the socket, and wherein the elastic body contains at least one of a circuit board which is flexible perpendicularly to the plane of the circuit board, a lead frame which is flexible perpendicularly to the plane of the lead frame, and a cable tree which is arranged inside one of the components.

12. The method for producing a plug connection of claim 11, wherein the completing and securing operation is performed by tightening a screw connection.

* * * * *